US011719139B2

(12) United States Patent
Hassall et al.

(10) Patent No.: US 11,719,139 B2
(45) Date of Patent: Aug. 8, 2023

(54) REDUCED PARASITIC LUBE SYSTEM

(71) Applicant: Cummins Inc., Columbus, IN (US)

(72) Inventors: Nathaniel P. Hassall, Hebei (CN); John Jerl Purcell, III, Louisa, VA (US); Stephen D. Cofer, Jr., Sugar Grove, PA (US); David M. Barnes, Columbus, IN (US); Aaron S. Quinton, Columbus, IN (US); Reid M. Irish, Stockton, NY (US)

(73) Assignee: CUMMINS INC., Columbus, IN (US)

( * ) Notice: Subject to any disclaimer, the term of this patent is extended or adjusted under 35 U.S.C. 154(b) by 198 days.

(21) Appl. No.: 16/346,403

(22) PCT Filed: Oct. 31, 2017

(86) PCT No.: PCT/US2017/059298
§ 371 (c)(1),
(2) Date: Apr. 30, 2019

(87) PCT Pub. No.: WO2018/081800
PCT Pub. Date: May 3, 2018

(65) Prior Publication Data

US 2019/0271241 A1 Sep. 5, 2019

Related U.S. Application Data

(60) Provisional application No. 62/414,997, filed on Oct. 31, 2016.

(51) Int. Cl.
*F01M 1/02* (2006.01)
*F01M 1/08* (2006.01)
(Continued)

(52) U.S. Cl.
CPC ..... *F01M 1/02* (2013.01); *F01M 1/00* (2013.01); *F01M 1/08* (2013.01); *F01M 1/10* (2013.01);
(Continued)

(58) Field of Classification Search
CPC .. F01M 1/02; F01M 1/00; F01M 1/08; F01M 1/10; F01M 5/002; F01M 11/0004; F01M 2001/1007; F01M 2011/026
See application file for complete search history.

(56) References Cited

U.S. PATENT DOCUMENTS 3,065,743 A * 11/1962 Brehm ..... F16N 39/00 123/41.08
3,090,365 A * 5/1963 Constantino ..... F01P 7/14 123/41.08
(Continued)

FOREIGN PATENT DOCUMENTS

CN 201152182 Y 11/2008
CN 102235203 A 11/2011
(Continued)

OTHER PUBLICATIONS

International Preliminary Reporton Patentability received for PCT Patent Application No. PCT/US2017/059298, dated Jul. 25, 2019, 8 pages.
(Continued)

*Primary Examiner* — Michael A Riegelman
(74) *Attorney, Agent, or Firm* — Faegre Drinker Biddle & Reath LLP

(57) ABSTRACT

The present disclosure provides a lubrication system comprising: a pump having an inlet in fluid communication with a lubricant source and an outlet; a cooler having an inlet in fluid communication with the outlet of the pump and an outlet; a lubrication filter having an inlet in fluid commu-
(Continued)

nication with the outlet of the cooler and an outlet; a first delivery path in fluid communication with the outlet of the lubrication filter, the first delivery path being configured to deliver cooled, filtered lubricant to a bearing system of an engine; and a second delivery path in fluid communication with the outlet of the pump, the second delivery path being configured to deliver uncooled, unfiltered lubricant to piston cooling nozzles of the engine.

7 Claims, 4 Drawing Sheets

(51) Int. Cl.

| | |
|---|---|
| ***F01M 1/10*** | (2006.01) |
| ***F01M 5/00*** | (2006.01) |
| ***F01M 11/00*** | (2006.01) |
| ***F01M 1/00*** | (2006.01) |
| *F01M 11/02* | (2006.01) |

(52) U.S. Cl.
CPC ..... *F01M 5/002* (2013.01); *F01M 11/0004* (2013.01); *F01M 2001/1007* (2013.01); *F01M 2011/026* (2013.01)

(56) References Cited

U.S. PATENT DOCUMENTS

| | | | | |
|---|---|---|---|---|
| 3,453,995 | A | 7/1969 | Pelizzoni et al. | |
| 3,465,847 | A * | 9/1969 | Gahler | F01M 11/03 184/6.4 |
| 3,485,324 | A | 12/1969 | Novak | |
| 3,741,342 | A * | 6/1973 | Maddalozzo | F01M 1/10 184/6.4 |
| 3,876,345 | A * | 4/1975 | Froede | F02B 55/04 418/84 |
| 4,058,981 | A * | 11/1977 | Henson | F01M 1/02 60/605.3 |
| 4,114,571 | A * | 9/1978 | Ruf | F01M 1/08 123/196 AB |
| 4,204,487 | A * | 5/1980 | Jones | F01M 1/08 123/196 AB |
| 4,503,679 | A * | 3/1985 | Saito | F02B 39/14 184/6.11 |
| 4,512,299 | A * | 4/1985 | Egan | F01M 1/10 123/196 A |
| 5,693,217 | A * | 12/1997 | Erdmannsdoerfer | B01D 36/045 210/97 |
| 6,951,606 | B2 * | 10/2005 | Cousineau | B01D 29/096 210/104 |
| 8,640,657 | B2 | 2/2014 | Huhn et al. | |
| 2003/0230274 | A1 * | 12/2003 | Williams | F01M 5/005 123/196 R |
| 2005/0120982 | A1 * | 6/2005 | Ducu | F01P 7/16 123/41.08 |
| 2006/0207543 | A1 * | 9/2006 | Rehr | F01M 5/002 123/196 AB |
| 2011/0297119 | A1 * | 12/2011 | Huhn | F01M 1/16 123/196 A |
| 2012/0080384 | A1 * | 4/2012 | Reinosa | B01D 35/147 210/695 |
| 2012/0138010 | A1 * | 6/2012 | Ulrey | F01M 1/08 123/196 R |
| 2013/0092118 | A1 * | 4/2013 | Steiner | F01M 11/02 123/196 R |
| 2013/0118439 | A1 * | 5/2013 | Kim | F01M 5/005 123/196 A |
| 2015/0275713 | A1 * | 10/2015 | Bidner | F01M 1/02 123/41.42 |
| 2015/0300218 | A1 * | 10/2015 | Taguchi | F01M 1/08 123/196 CP |
| 2016/0153408 | A1 * | 6/2016 | Amaral | F01P 3/20 123/557 |
| 2016/0265490 | A1 * | 9/2016 | Azevedo Junior | F01M 5/002 |
| 2019/0271241 | A1 * | 9/2019 | Hassall | F01M 11/0004 |
| 2019/0292944 | A1 * | 9/2019 | Mason | F01D 25/20 |

FOREIGN PATENT DOCUMENTS

| | | | |
|---|---|---|---|
| CN | 205025524 | U | 2/2016 |
| DE | 97262 | A1 | 4/1973 |
| DE | 102008032496 | A1 | 1/2010 |
| EP | 3150811 | A1 | 4/2017 |
| JP | 58-149506 | U | 10/1983 |

OTHER PUBLICATIONS

International Search Report and Written Opinion issued by the ISA/US, Commissioner for Patents, dated Feb. 1, 2018, for International Application No. PCT/US2017/059298; 8 pages.

* cited by examiner

FIG. 1 – PRIOR ART

REDUCED PARASITIC LUBE SYSTEM

CROSS-REFERENCE TO RELATED APPLICATIONS

This application is a national phase filing of International Application Number PCT/US2017/059298, entitled "REDUCED PARASITIC LUBE SYSTEM," filed on Oct. 31, 2017, which claims priority to U.S. Provisional Application Ser. No. 62/414,997, entitled "REDUCED PARASITIC LUBE SYSTEM," filed on Oct. 31, 2016, the entire disclosures of which being hereby expressly incorporated herein by reference.

TECHNICAL FIELD

The present invention relates generally to engine lubrication systems and more particularly to systems having dedicated lubrication circuits to reduce parasitic power.

BACKGROUND

Engine lubrication systems (for diesel, gasoline and/or natural gas engines, and in particular reciprocating piston engines) generally provide a lubricant such as oil to various components of the engine. FIG. 1 depicts a prior art lubrication system. As shown, oil is pumped from an oil pan 12 by a lube pump 14 to a lube cooler 16. The cooled oil is passed through a lube filter 18 and provided to the bearing systems 20 of the engine and the piston cooling nozzles ("PCN") circuit 22. The oil is returned from bearing systems 20 and PCN circuit 22 to oil pan 12 for reuse. Thus, the entire flow of oil from oil pan 12 is cooled (by cooler 16) and filtered (by filter 18) before being routed to bearing system 20 and PCN circuit 22. As filter 18 is a key flow restriction in system 10, a substantial pressure head is generated for lube pump 14. This pressure head increases the parasitic power required to operate the system, thereby resulting in undesirable fuel consumption. Accordingly, an approach for providing lubricant to engine components that results in reduced parasitic power is needed.

SUMMARY

According to one embodiment, the present disclosure provides a lubrication system, comprising: a pump having an inlet in fluid communication with a lubricant source and an outlet; a cooler having an inlet in fluid communication with the outlet of the pump and an outlet; a lubrication filter having an inlet in fluid communication with the outlet of the cooler and an outlet; a first delivery path in fluid communication with the outlet of the lubrication filter, the first delivery path being configured to deliver cooled, filtered lubricant to a bearing system of an engine; and a second delivery path in fluid communication with the outlet of the pump, the second delivery path being configured to deliver uncooled, unfiltered lubricant to piston cooling nozzles of the engine. One aspect of this embodiment further comprises a return path in fluid communication with the bearing system and the piston cooling nozzles to return lubricant to the lubricant source. Another aspect further comprises a screen disposed in the second delivery path for inhibiting passage of large particles to the piston cooling nozzles. In another aspect, the pump draws an amount of lubricant from the lubrication source and the cooled, filtered lubricant delivered to the bearing system of the engine constitutes about 50% of the amount of lubricant drawn from the lubrication source.

In another embodiment, the present disclosure provides a lubrication system, comprising: a pump having an inlet in fluid communication with a lubricant source and an outlet; a cooler having an inlet in fluid communication with the outlet of the pump and an outlet; a lubrication filter having an inlet in fluid communication with the outlet of the cooler and an outlet; a first delivery path in fluid communication with the outlet of the lubrication filter, the first delivery path being configured to deliver cooled, filtered lubricant to a bearing system of an engine; and a second delivery path in fluid communication with the outlet of the cooler, the second delivery path being configured to deliver cooled, unfiltered lubricant to piston cooling nozzles of the engine. One aspect of this embodiment further comprises a return path in fluid communication with the bearing system and the piston cooling nozzles to return lubricant to the lubricant source. Another aspect further comprises a screen disposed in the second delivery path for inhibiting passage of large particles to the piston cooling nozzles.

In yet another embodiment, the present disclosure provides a lubrication system, comprising: a pump having an inlet in fluid communication with a lubricant source and an outlet; a cooler having an inlet in fluid communication with the outlet of the pump and an outlet; a lubrication filter having an inlet in fluid communication with the outlet of the pump and an outlet; a first delivery path in fluid communication with the outlet of the lubrication filter, the first delivery path being configured to deliver uncooled, filtered lubricant to a bearing system of an engine; and a second delivery path in fluid communication with the outlet of the cooler, the second delivery path being configured to deliver cooled, unfiltered lubricant to piston cooling nozzles of the engine. One aspect of this embodiment further comprises a return path in fluid communication with the bearing system and the piston cooling nozzles to return lubricant to the lubricant source. Another aspect further comprises a screen disposed in the second delivery.

In yet another embodiment of the present disclosure, a method of providing lubricant to a bearing system of an engine and piston cooling nozzles of the engine is provided, comprising: pumping lubricant from a lubricant source to a pump outlet; routing a first portion of the pumped lubricant from the pump outlet to an inlet of a cooler, the cooler having an outlet; routing a second portion of the pumped lubricant from the pump outlet to the piston cooling nozzles; routing lubricant from the cooler outlet to an inlet of a lubrication filter, the lubrication filter having an outlet; and routing lubricant from the lubrication filter outlet to the bearing system. One aspect of this embodiment further comprises routing lubricant from the bearing system and the piston cooling nozzles through a return path to the lubricant source. In another aspect, routing a second portion of the pumped lubricant includes passing the second portion of the pumped lubricant through a screen to inhibit passage of large particles to the piston cooling nozzles.

In still another embodiment, the present disclosure provides a method of providing lubricant to a bearing system of an engine and piston cooling nozzles of the engine, comprising: pumping lubricant from a lubricant source to a pump outlet; routing the pumped lubricant from the pump outlet to an inlet of a cooler, the cooler having an outlet; routing a first portion of lubricant from the cooler outlet to the piston cooling nozzles; routing a second portion of the lubricant from the cooler outlet to an inlet of a lubrication filter, the lubrication filter having an outlet; and routing lubricant from the lubrication filter outlet to the bearing system. One aspect of this embodiment further comprises routing lubricant from the bearing system and the piston cooling nozzles through a return path to the lubricant source. In another aspect, routing a first portion of the lubricant from the cooler includes passing the first portion of the lubricant through a screen to inhibit passage of large particles to the piston cooling nozzles.

In yet another embodiment, the present disclosure provides a method of providing lubricant to a bearing system of an engine and piston cooling nozzles of the engine, comprising: pumping lubricant from a lubricant source to a pump outlet; routing a first portion of the pumped lubricant from the pump outlet to an inlet of a cooler, the cooler having an outlet; routing a second portion of the pumped lubricant from the pump outlet to an inlet of a lubrication filter, the lubrication filter having an outlet; routing lubricant from the cooler outlet to the piston cooling nozzles; and routing lubricant from the lubrication filter outlet to the bearing system. One aspect of this embodiment further comprises routing lubricant from the bearing system and the piston cooling nozzles through a return path to the lubricant source. In another aspect, routing lubricant from the cooler outlet includes passing the lubricant through a screen to inhibit passage of large particles to the piston cooling nozzles.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

BRIEF DESCRIPTION OF THE DRAWINGS

The above-mentioned and other features of this disclosure and the manner of obtaining them will become more apparent and the disclosure itself will be better understood by reference to the following description of embodiments of the present disclosure taken in conjunction with the accompanying drawings, wherein.

Figure 1:
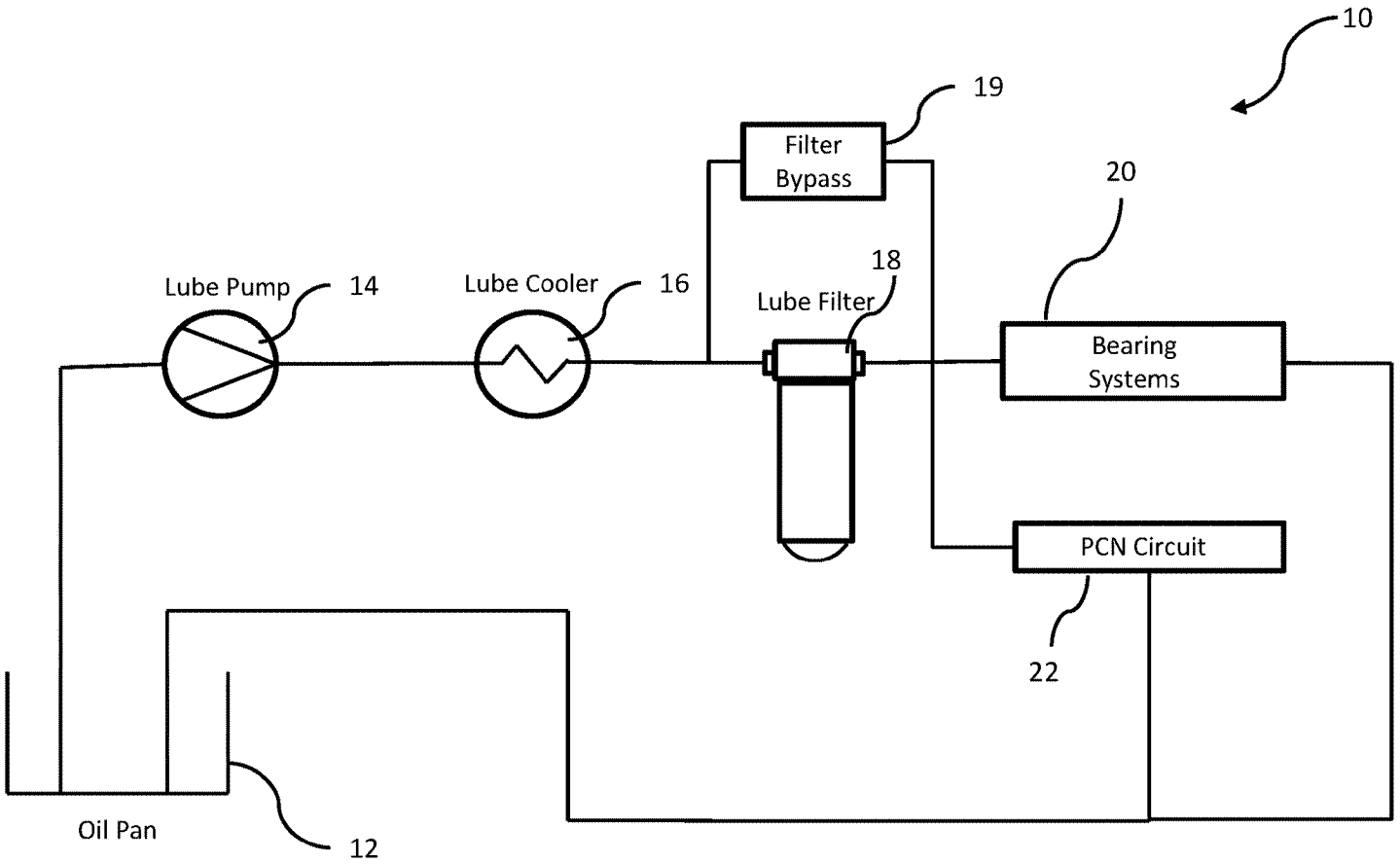
FIG. 1 is a schematic diagram of a prior art engine lubrication system.

While the present disclosure is amenable to various modifications and alternative forms, specific embodiments have been shown by way of example in the drawings and are described in detail below. The present disclosure, however, is not intended to limit the particular embodiments described. On the contrary, the present disclosure is intended to cover all modifications, equivalents, and alternatives falling within the scope of the appended claims.

DETAILED DESCRIPTION

As described in detail below, the embodiments of the present disclosure provide dedicated circuits or delivery paths for the engine bearing system and the PCN circuit. As such, certain components of the lubrication system are bypassed in a way that reduces the parasitic losses of the system, which thereby improves engine efficiency and fuel consumption.

Figure 2:
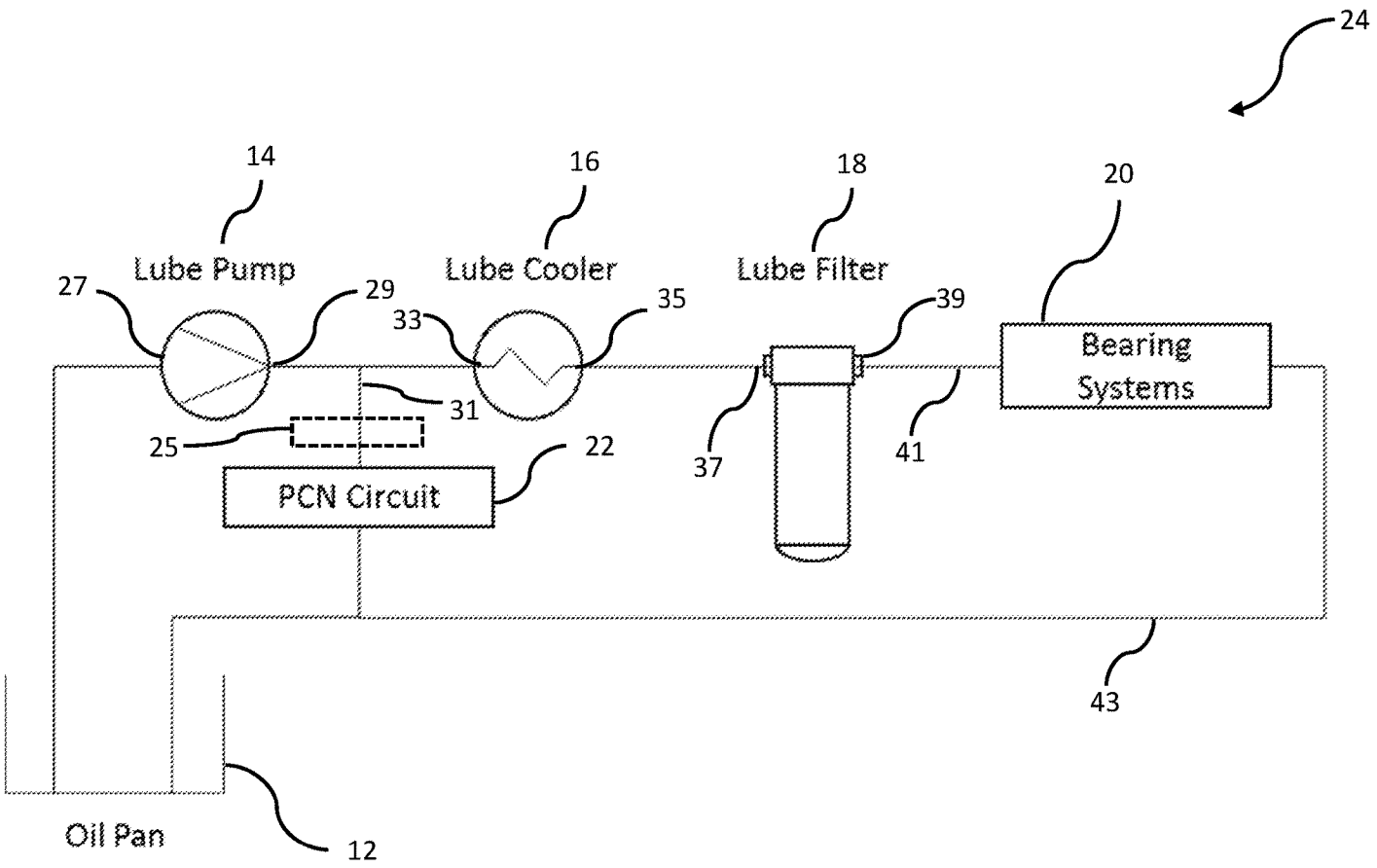
FIG. 2 is a schematic diagram of a first embodiment of an engine lubrication system according to the present disclosure.

Referring now to FIG. 2, a first embodiment of a lubrication system according to the present disclosure is shown. System 24 includes the same components as those described above with reference to the prior art system 10. Accordingly, the same reference designations are used. As shown, oil is pumped from oil pan 12 to inlet 27 of lube pump 14. From outlet 29 of lube pump 14, oil is provided directly to PCN circuit 22 via delivery path 31. It should be understood that oil provided to PCN circuit 22 may be passed through a screen (e.g., a 300 micron screen) to prevent large particles from reaching the piston cooling nozzles. Screen 25 is depicted in dotted lines. Oil is also provided by pump 14 to inlet 33 of lube cooler 16. Cooled oil flows from outlet 35 of cooler 16 to inlet 37 of lube filter 18 before being routed from outlet 39 of lube filter 18 to bearing systems 20 delivery path 41. Oil is returned from bearing systems 20 and PCN circuit 22 via return path 43 to oil pan 12. Thus, in this embodiment only a portion (e.g., approximately 50%) of the oil flow is filtered (i.e., the portion provided to bearing systems 20). As such, cooled and filtered oil is only provided to bearing system 20 while uncooled and unfiltered oil is provided to PCN circuit 22. This reduction in filtered flow results in an overall reduction in the pressure delta across pump 14. Moreover, by employing system 24, the filter bypass system 19 may be removed, reducing the possibility that unfiltered oil may leak into the bearings causing damage. In fact, conventional systems (such as that depicted in FIG. 1) contain filters sized for peak flow, but require bypass systems for when the filters become partially clogged. As a result of the embodiment of FIG. 2, the previously acceptable filter size is now large enough not to suffer from partial blockage, without a bypass system.

To accommodate the reduced power needs of system 24, the gerotors or gears (depending on the platform) are adjusted down as required. Thus, pumping work is reduced, bypass leakage is reduced, implementation is fast, reliability is improved by removing the bypass, and cost is reduced. It should further be apparent to those skilled in the art with the benefit of the teachings of the present disclosure that the reduced filtered flow provided by system 24 may be combined with PCN shutoff features and variable flow pumps to further reduce circuit parasitic power. More specifically, PCN flow may be switched on and off depending on thermal load if a variable flow lube pump is used. This optional "higher complexity" lube circuit control reduces parasitic lube circuit power when piston temperatures permit.

Finally, it should also be understood that check valves/solenoid valves may be included in the PCN circuit. Moreover, thermostat(s) may be used in the various circuits and lube pump 14 may be configured as a standard or variable pump.

Figure 3:
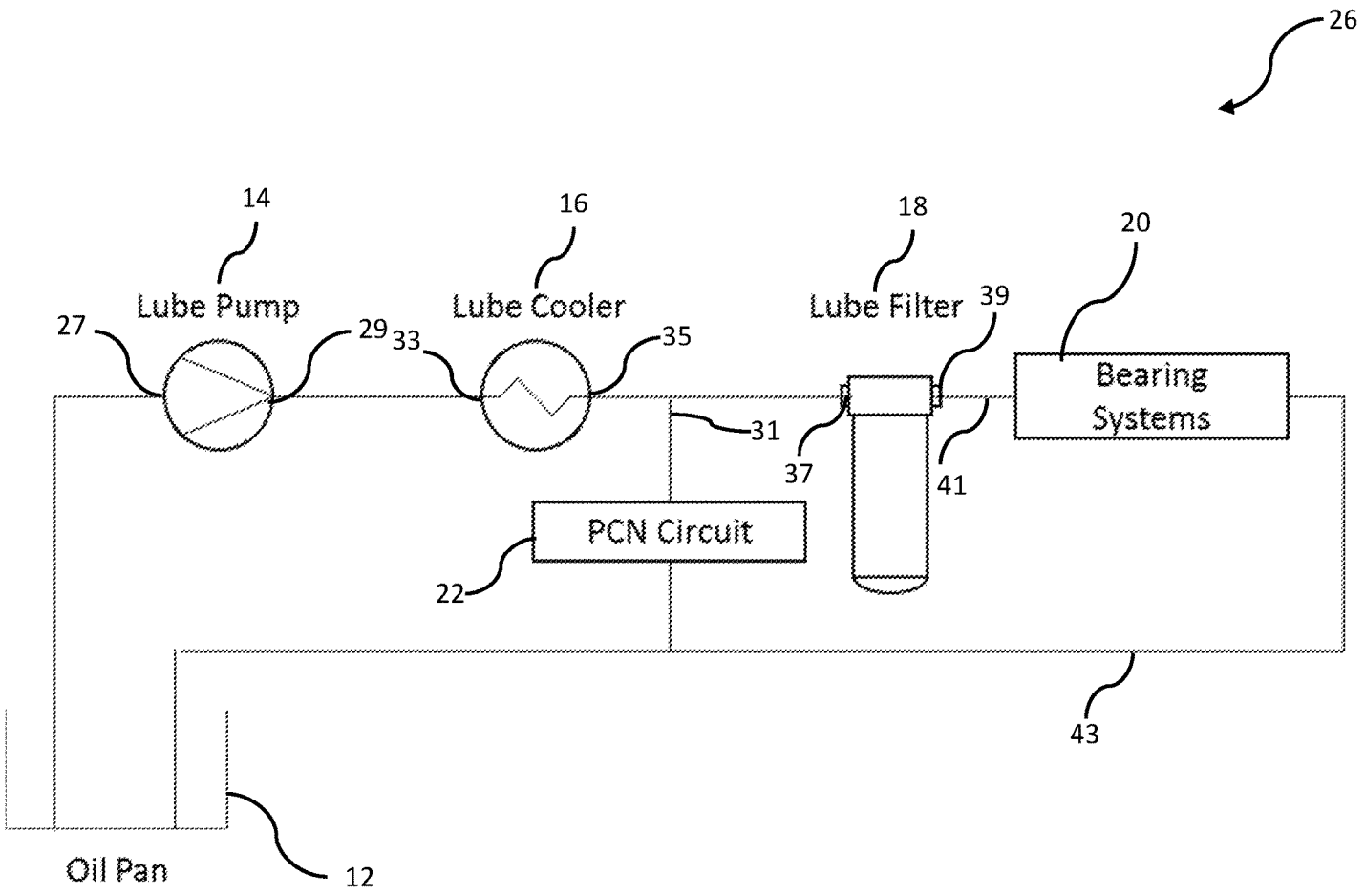
FIG. 3 is a schematic diagram of a second embodiment of an engine lubrication system according to the present disclosure.

Referring now to FIG. 3, another embodiment of a system according to the present disclosure is shown. System 26 includes the same components as system 24. Accordingly, the same reference designations are used. In system 26, oil is pumped from oil pan 12 to inlet 27 of pump 14. Oil is pumped from outlet 29 of pump 14 to inlet 33 of cooler 16. Cooled oil is then routed from outlet 35 of cooler 16 to PCN circuit 22 via delivery path 31 and to inlet 37 of filter 18. Cooled, filtered oil is routed from outlet 39 of filter 18 to bearing systems 20 via delivery path 41. Return oil is routed from bearing systems 20 and PCN circuit 22 to oil pan 12 via return path 43. It should be noted that system 26 may also include a screen 25 (as described above with reference to system 24) between cooler 16 and PCN circuit 22 in delivery path 31.

System 26 thus differs from system 24 in that in system 26, oil is passed through cooler 16 before being routed to PCN circuit 22 whereas in system 24 the oil is provided to PCN circuit 22 directly from pump 14 (i.e., the oil is not passed through cooler 16 before flowing to PCN circuit 22). Thus, in system 26, cooled and unfiltered oil is provided to PCN circuit 22.

Figure 4:
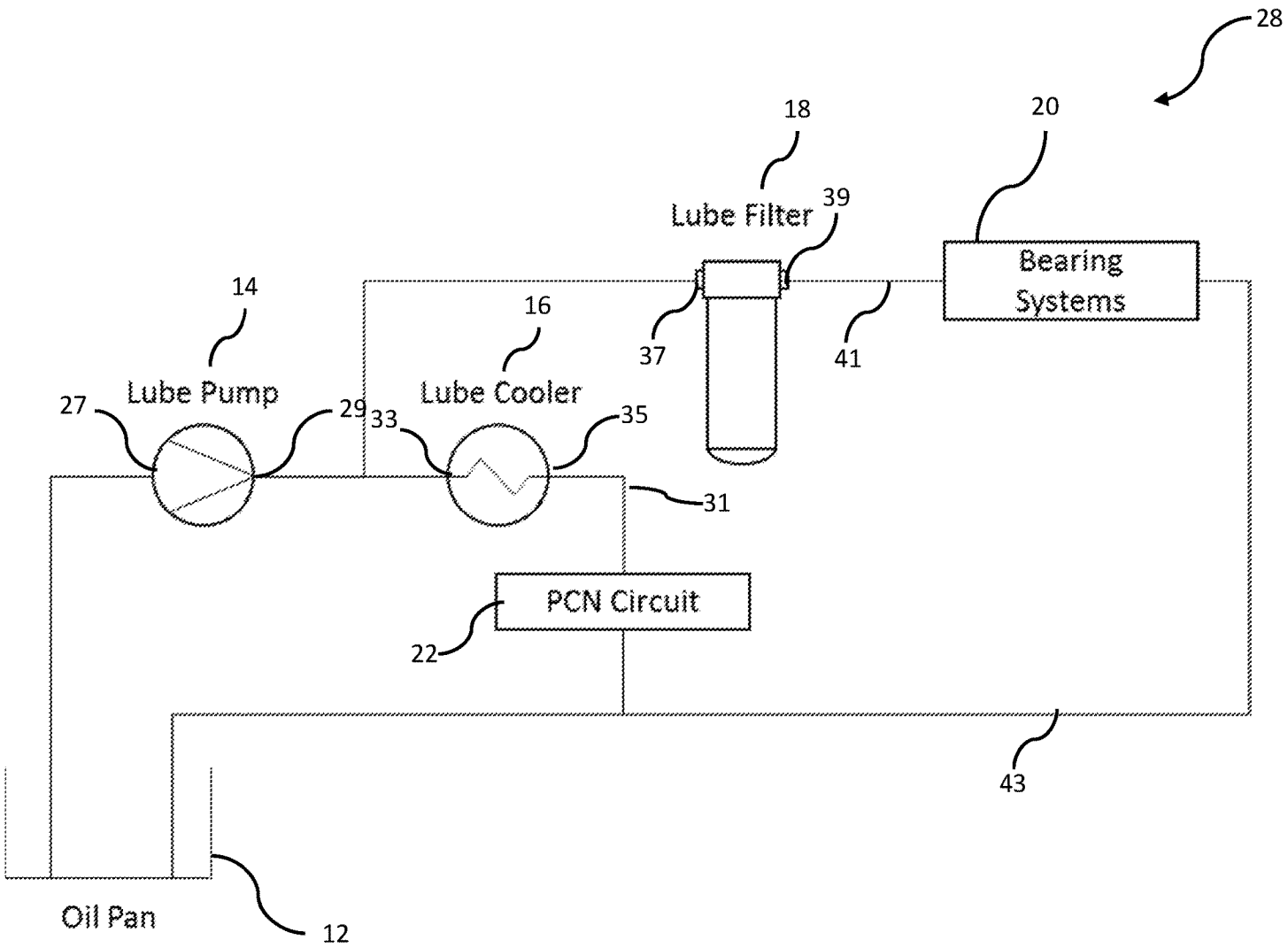
FIG. 4 is a schematic diagram of a third embodiment of an engine lubrication system according to the present disclosure.

Referring now to FIG. 4, another embodiment of a system according to the present disclosure is shown. System 28 includes the same components as system 24. Accordingly, the same reference designations are used. In system 28, oil is pumped from oil pan 12 to inlet 27 of pump 14. Oil is pumped from outlet 29 of pump 14 to inlet 33 of cooler 16 and inlet 37 of filter 18. Cooled oil is then routed from outlet 35 of cooler 16 to PCN circuit 22 via delivery path 31. Uncooled, filtered oil is routed from outlet 39 of filter 18 to bearing systems 20 via delivery path 41. Return oil is routed from bearing systems 20 and PCN circuit 22 to oil pan 12 via return path 43. It should be noted that system 28 may also include a screen 25 (as described above with reference to system 24) between cooler 16 and PCN circuit 22.

System 28 thus differs from system 26 in that in system 28, the oil pumped to filter 18 is not passed through cooler 16 whereas in system 26 the oil is cooled before being provided to filter 18 (and bearing systems 20). This embodiment provides increased cooling to the piston and rings via the cooled oil flow while delivering higher temperature oil to the bearings which reduces the parasitic power required to rotate the crankshaft and camshaft in their respective bearings.

As used herein, the modifier "about" used in connection with a quantity is inclusive of the stated value and has the meaning dictated by the context (for example, it includes at least the degree of error associated with the measurement of the particular quantity). When used in the context of a range, the modifier "about" should also be considered as disclosing the range defined by the absolute values of the two endpoints. For example, the range "from about 2 to about 4" also discloses the range "from 2 to 4."

The connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements. The scope is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B or C may be present in a single embodiment; for example, A and B, A and C, B and C, or A and B and C.

In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art with the benefit of the present disclosure to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

We claim:

1. A lubrication system, comprising:

a pump having an outlet and an inlet in fluid communication with a lubricant source, the pump not in fluid communication with a bypass;

a cooler having an outlet and an inlet in fluid communication with the outlet of the pump;

a lubrication filter having an outlet and an inlet in fluid communication with the outlet of the cooler to receive cooled lubricant from the outlet of the cooler;

a first delivery path in fluid communication with the outlet of the lubrication filter, the first delivery path being configured to deliver cooled, filtered lubricant to a bearing system of an engine, the first delivery path including the cooler and the lubrication filter disposed downstream of the cooler, the cooler receiving uncooled, unfiltered lubricant from the pump and ejecting cooled, unfiltered lubricant, the lubrication filter receiving cooled, unfiltered lubricant from the cooler and ejecting cooled, filtered lubricant; and a second delivery path including the pump, a screen, and piston cooling nozzles of the engine, the second delivery path configured to deliver uncooled lubricant directly from the outlet of the pump into the screen and directly from the screen to the piston cooling nozzles;

wherein the pump draws an amount of lubricant from the lubrication source, the amount of lubricant being split between the first delivery path and the second delivery path, the cooled, filtered lubricant delivered to the bearing system of the engine constitutes a portion of the amount of lubricant drawn from the lubrication source, and a remaining portion of the amount of lubricant being delivered to the piston cooling nozzles.

2. The lubrication system of claim 1, further comprising a return path in fluid communication with the bearing system and the piston cooling nozzles to return lubricant to the lubricant source.

3. The lubrication system of claim 1, wherein the screen is a 300 micron screen.

4. A method of providing lubricant to a bearing system of an engine and piston cooling nozzles of the engine, comprising:

pumping, via a pump, lubricant from a lubricant source to a pump outlet;

routing a first portion of the pumped lubricant from the pump outlet to an inlet of a cooler, the cooler having an outlet;

routing a second portion of the pumped lubricant from the pump outlet to the piston cooling nozzles that is filtered without being cooled;

routing lubricant from the cooler outlet directly to an inlet of a lubrication filter, the lubrication filter having an outlet; and routing cooled, filtered lubricant from the lubrication filter outlet to the bearing system;

wherein pumping lubricant from a lubricant source to the pump outlet includes drawing, via the pump, an amount of lubricant from the lubrication source, the amount of lubricant being wholly split between the first and second portions of lubricant such that the cooled, filtered lubricant delivered to the bearing system of the engine constitutes a half portion of the amount of lubricant drawn from the lubrication source, and the remaining half portion of the lubricant being delivered to the piston cooling nozzle while preventing large particles from reaching the piston cooling nozzles without being cooled.

5. The method of claim 4, further comprising routing lubricant from the bearing system and the piston cooling nozzles through a return path to the lubricant source.

6. The method of claim 4, wherein routing a second portion of the pumped lubricant includes passing the second portion of the pumped lubricant through a screen to inhibit passage of large particles to the piston cooling nozzles.

7. The method of claim 6, wherein the screen is a 300 micron screen.

* * * * *